United States Patent [19]

Barker

[11] Patent Number: 4,742,797

[45] Date of Patent: May 10, 1988

[54] TEAR DROP SEAL

[75] Inventor: Laurence S. Barker, Fairport, N.Y.

[73] Assignee: Xerox Corporation, Stamford, Conn.

[21] Appl. No.: 66,151

[22] Filed: Jun. 25, 1987

[51] Int. Cl.[4] ..... G03G 15/8

[52] U.S. Cl. ..... 118/652; 118/653; 118/50; 355/3 DD; 277/184; 277/DIG. 7; 29/453

[58] Field of Search ..... 118/652, 50, 653; 355/3 DD; 277/205, 184, DIG. 7; 29/453

[56] References Cited

U.S. PATENT DOCUMENTS

| | | | |
|---|---|---|---|
| 3,272,521 | 9/1966 | McNenny | 277/205 |
| 3,906,899 | 9/1975 | Harpavat | 118/655 |
| 3,939,576 | 2/1976 | Lawrence | 277/DIG. 7 |
| 4,101,211 | 7/1978 | Kayson | 355/3 DD |
| 4,232,628 | 11/1980 | Shelffo | 118/653 |
| 4,337,724 | 7/1982 | Hosono et al. | 355/3 DD X |
| 4,559,899 | 12/1985 | Kan et al. | 118/657 |
| 4,596,455 | 6/1986 | Kohyama et al. | 355/3 DD |
| 4,681,426 | 7/1987 | Bean et al. | 118/652 X |
| 4,690,544 | 9/1987 | Forbes, II et al. | 118/652 X |

*Primary Examiner*—Richard R. Bueker
*Assistant Examiner*—Alain Bashore

[57] ABSTRACT

A device for sealing a space between two adjacent surfaces comprises a seal holder, a flexible thin sheet-like member folded back on itself forming a deformed cylinder having a generally tear-drop shaped cross section, the two ends of the folded back sheet-like member being held and retained in close proximity by the seal holder to maintain the tear-drop shaped cross section with the seal holder being mounted on one surface relative to the other surface such that a portion of the deformed cylinder forms at least a line contact seal engagement with that surface. In a preferred embodiment, the two ends of the folded back sheet-like member have end portions folded over in the same direction, one nesting inside the other forming an acute angle with an adjacent portion of the deformed cylinder with the width of the outermost folded end portion being greater than the width of the innermost folded portion thereby providing an achoring hook for supporting engagement with the seal holder wherein the innermost folded end portion is permitted to move axially relative to the outermost folded end portion to maintain line contact sealing engagement with the surface. The seal holder includes a groove-like chamber for supporting the seal anchoring hook, a narrow insertion slot and a hook retaining lip. In a preferred application, a sealing device is used in sealing a developer and/or cleaner housing in eletrostatographic reproducing apparatus.

22 Claims, 4 Drawing Sheets

TEAR DROP SEAL

BACKGROUND OF THE INVENTION

The present invention relates to a sealing device and more particularly to a sealing device for sealing the cleaner and/or developer housing in electrostatographic reproducing apparatus.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive areas. Alternatively, single component development systems may be employed which utilize only charged toner particles. The thusly formed toner image may subsequently be transferred to a support surface such as copy paper to which it may be permanently affixed by heating or by the application of pressure.

In commercial applications of this process it is essential to contain the finely divided toner particles in their functional areas since if they are permitted to escape or circulate freely after a certain period of time, they will contaminate various functional surfaces rendering other functional elements of the process and the apparatus incapable of producing acceptable toner images. For example, they may be deposited on the imaging platen thereby creating background marks on any subsequent copy made from a document placed on the imaging platform. In addition, they may contaminate various electrical features such as the corona generating devices thereby rendering them ineffective in their charging or discharging functions. Finally, they can be a source of contamination to the prints produced therefrom and the operator of the machine. These difficulties are particularly encountered with the developer housing and the cleaner housing since these two housings contain substantial quantities of toner which if permitted to exit the respective housing will thoroughly contaminate the automatic printing machine rendering it incapable of performing its normal function. As a result, various types of sealing arrangements have been devised to contain developer and/or toner within the developer housing prior to its being consumed in the development process and also in the cleaner housing where residual spent toner is collected in a sump. These sealing devices takes various forms of implementation including the use of brushes, foams and combinations thereof. One of the most common types of sealing arrangements has been the use of a flat piece of a polyester film, Mylar, for example, in the form of a flap seal between the developer and/or cleaner housing and the imaging member. While satisfactory in many respects, difficulties are encountered with such a flap seal in that it is typically mounted as a flat strip by way of an adhesive or a clamp to the housing and any deviation or variation in the parallelism between the seal mount and the imaging member along its length will be observed between the deflected seal and the imaging member because the seal follows the mount and not the imaging member. In other words, small gaps may be formed in the interface between the deflected seal and the imaging member thereby permitting toner to escape. Furthermore, such use of adhesives or clamping devices in mounting the seal may introduce stresses into the flap seal with the formation of ripples at the seal edge, the edge becoming wavy providing small openings in the seal edge from which the toner may leak out. Accordingly, there is a desire provide a more effective seal in sealing the interface between the developer housing and/or a cleaner housing and the imaging member.

PRIOR ART

U.S. Pat. No. 3,906,899 to Harpavat discloses a magnetic seal for a developer housing in an electrostatographic printing apparatus. The seal is U-shaped having a channel with two parallel spaced thin magnetic pole edge field areas and a much wider recess therebetween to contain captured magnetic material.

U.S. Pat. No. 4,101,211 to Kayson describes a magnetic curtain seal to minimize toner dust which might escape from the sump into the development station. The magnetic curtain seals each include two spaced permanent magnets secured to a metallic keeper or magnetic sump member. An arcuate metallic shoe is fixed to the bottom of both magnets. The developer is attracted to the shoe forming a curtain seal which blocks the flow of air.

U.S. Pat. No. 4,559,899 to Kan et al. discloses a sealing member which can allows the developer to return to the developer supply container while preventing magnetic particles form leaking out of the container. The sealing member which may be sheet of flexible material such as polyethylene terephthalate is curled and is configured to lightly contact the surface of the developer carrying member.

SUMMARY OF THE INVENTION

In a principle aspect of the present invention, a sealing device is provided which includes a seal holder, a flexible thin sheet-like member folded back on itself forming a deformed cylinder having a generally tear drop shaped cross section the two ends of the folded back sheet-like member being held and retained in close proximity by the seal holder to maintain the tear drop shape cross section of the folded back sheet-like member and the seal holder is mounted relative to the surface to be sealed such that a portion of the deformed cylinder forms at least a line contact seal engagement with the surface.

In a further principle aspect of the present invention, the two ends of the folded back sheet-like member at end portions are folded over in the same direction, one nesting inside the other forming an acute angle with an adjacent portion of the deformed cylinder and width of the outermost folded end portion is greater than the width of the outermost folded end portion is greater than the width of the innermost folded over end portion the folded end portions providing an anchoring hook for supporting engagement with the holder which permits the innermost folded end portion to move axially relative to the outermost folded end portion to maintain line contact seal engagement with the surface.

In a further aspects of the present invention, the seal holder includes a slot with a longitudinal seal anchoring hook supporting groove-like chamber having a stop surface for engagement with the edges of the folded over end portions and narrow longitudinal seal insertion slot for inserting the seal anchoring hook into the groove-like chamber and at least one anchoring hook retaining lip on a side of the insertion slot for retaining the anchoring hook in the groove-like chamber whereby engagement of the stop surface with the edge of the folded over end portions permit the innermost folder over end portion to move axially relative to the outermost folded over end portion.

In a further aspect of the present invention, the two ends of the sheet-like member are fastened together in the seal holder and may be fastened directly to the seal holder.

In a further aspect of the present invention, the seal is used to seal the space in an electrostatographic reproducing apparatus between the developer housing and a developer donor roll which extends in the axial direction of the donor roll and is defined by the donor roll surface and a portion of the developer housing.

In a further aspect of the present invention, the seal is used to seal the spaced formed between a cleaner housing and the surface of an imaging member.

Other aspects of the present invention will become apparent as the following description proceeds and with reference to the drawings.

DESCRIPTION OF THE PREFERRED EMBODIMENT

Figure 1:
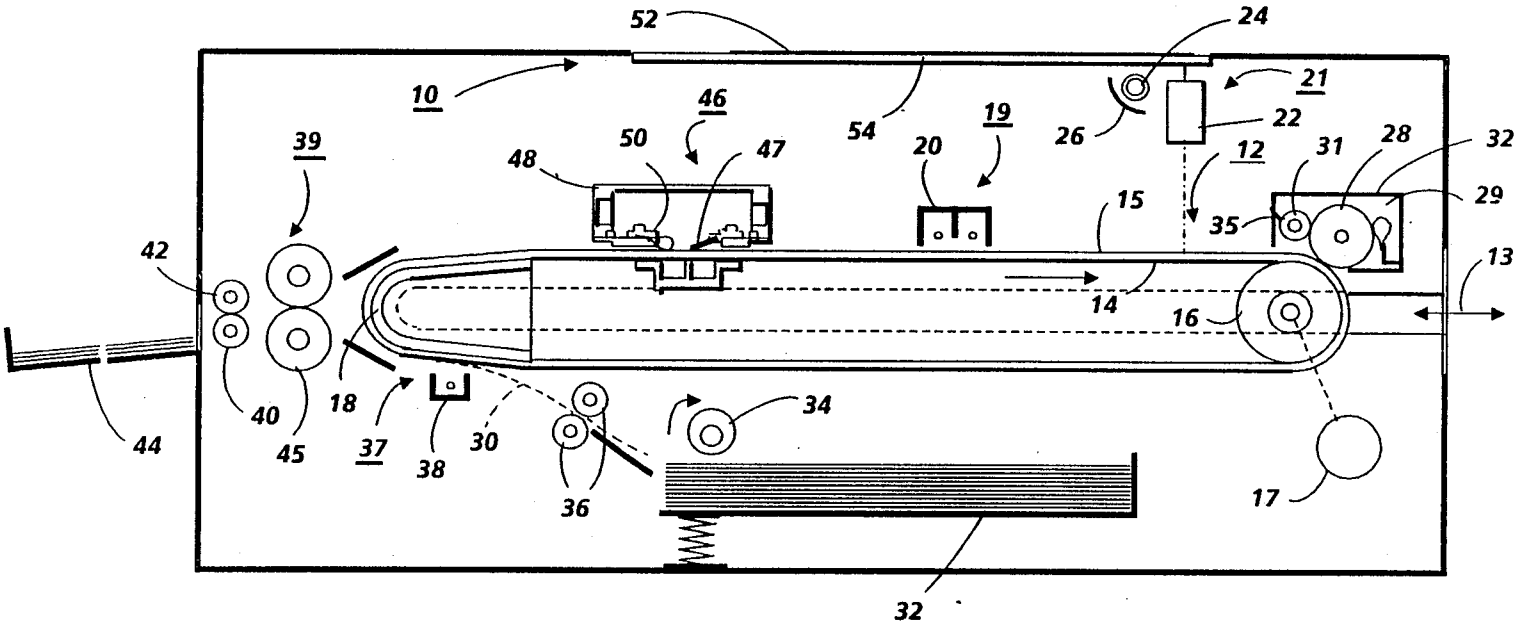
FIG. 1 is schematic representation in cross section of an automatic electrostatographic reproducing machine employing the sealing device according to the present invention in both the developer housing the cleaner housing.

For a general understanding of the features of the present invention, reference is made to the drawings. In the drawings like reference numerals have been used throughout to designate identical elements. While the sealing device according to the present invention is described with reference to an illustrative electrostatographic printing machine, it will become evident from the following discussion that the sealing device is well suited for use in a variety of other applications and is not necessarily limited in its application to the particular electrostatographic printing machine described herein.

Referring now to FIG. 1, there is shown by way of example, an automatic electrostatographic reproducing machine 10 which includes a removable processing cartridge employing the sealing device according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other systems such as printers and is not necessarily limited in application to the particular embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 and the outer periphery of which is coated with a suitable photoconductive material 15. The belt is suitably mounted for revolution within the cartridge about driven transport roll 16, around belt tracking shoe 18 and travels in the direction indicated by the arrows on the inner run of the belt to bring the image bearing surface thereon past the plurality of xerographic processing stations. Suitable drive means such as motor 17 are provided to power and coordinate the motion of the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image. The exposure station 21 may comprise a bundle of image transmitting fiber lenses 22 produced under the tradename of "SELFOC" by Nippon Sheet Glass Company Limited, together with an illuminating lamp 24 and a reflector 26. After exposure of the belt 15 the electrostatic latent image recorded on the photoconductive surface 15 is transported to a development station, wherein developer is applied to the photoconductive surface of the drum 15 rendering the latent image visible. Suitable development station could include developer donor roll 28, a toner supply reservoir 29 and a metering charging roller 31 contained within developer housing 32 with a tear drop sealing the interface between the donor roll 28 and the housing 32 in a manner described in greater detail with reference to FIG. 3.

Sheets 30 of the final support material are supported in a stack arrangement on elevated stack support tray 32. With the stack at its elevated position, the sheet separator segmented feed roll 34, feeds individual sheets therefrom to the registration pinch roll pair 36. The sheet is then forwarded to the transfer station 37 in proper registration with the image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the belt tracking shoe 18, with the sheet containing the toner image thereon which is advanced to fixing station 39 wherein roll fuser 40 fixes the transferred powder image thereto. After fusing the toner image to the copy sheet, the sheet 30 is advanced by output rolls 42 to sheet stacking tray 44.

Although a preponderance of toner powder is transferred to the final support material 30, invariably some residual toner remains on the photoconductive surface 15 after the transfer of the toner powder image to the final support material. The residual toner particles remaining on the photoconductive surface after the transfer operation are removed from the belt 14 by the cleaning station 46 which comprises a cleaning blade 47 in scrapping contact with the outer periphery of the belt 14 and contained within cleaning housing 48 which has a cleaning seal 50 associated with the upstream opening of the cleaning housing as will be described in greater detail with reference to FIG. 7.

Normally when the copier is operated in the conventional mode, the original document 52 to be reproduced is placed image side down upon a horizontal transport viewing platen 54 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

Figure 3:
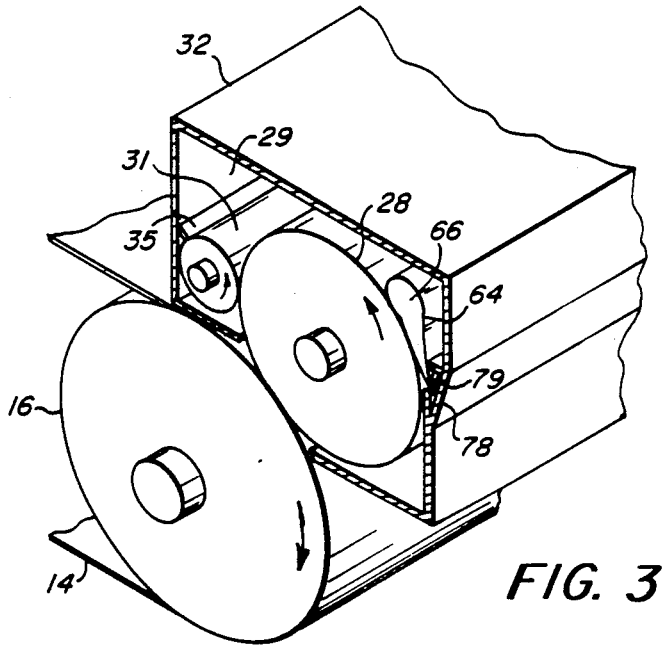
FIG. 3 is an isometric view from one end of a portion of the developer apparatus illustrated in FIG. 1 illustrating the sealing device according to the present invention.

The tear drop seal according to the present invention will be described in greater detail with reference to FIG. 2 and additional reference to the preferred embodiment illustrated in FIGS. 4, 5 and 6. It will be understood that while FIGS. 2, 5 and 6 are schematic representations in cross section only, they represent a series of longitudinal surfaces as illustrated in FIG. 3.

Figure 2:
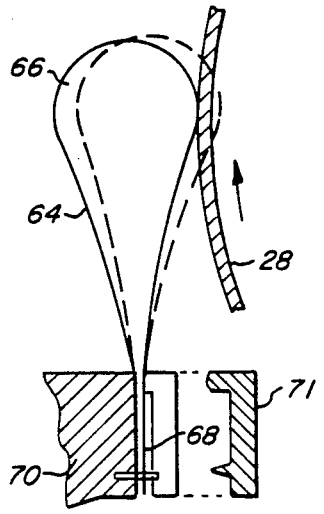
FIG. 2 is enlarged view of a sealing device according to the present invention in its simplest form.

FIG. 2 illustrates a tear drop seal in one of its simplest forms wherein a flexible thin sheet-like member 64 is folded back on itself forming a deformed cylinder having generally tear drop-shaped cross section 66. The two ends of the folded back sheet-like member may be fastened together at 68 and clamped to frame 70 with an ultrasonically welded strip 71. The frame 70 is positioned such that a portion of the head of the tear drop is parallel to and in contact with the surface to be sealed such as donor roll 28 and deflected by that surface from its unrestrained position illustrated in dotted line to its deflected or sealing position illustrated in solid line. This provides a line contact seal engagement between the deformed cylinder seal and the surface of the donor roll 28 and because the sealing member is generally cylindrical in nature it tends to maintain the line contact with the surface along the interface between the deformed cylinder and the donor roll surface.

Figure 5:
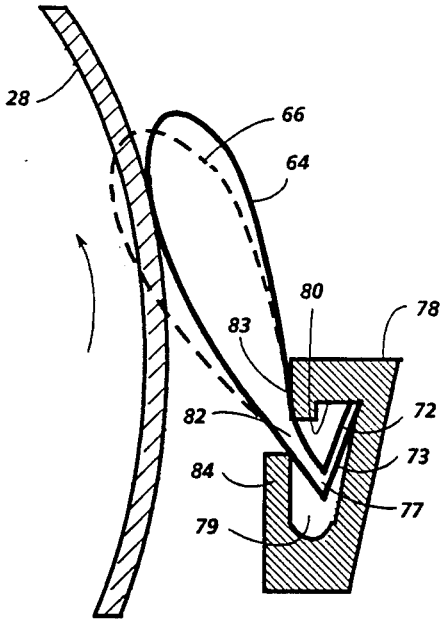
FIGS. 5 and 6 illustrate the preferred embodiment for the sealing device including the seal holder and how the innermost folded over end portion is permitted to move axially or float relative to the outermost folded over end portion.
Figure 6:
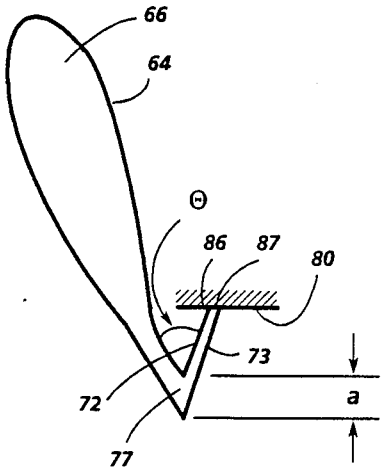
Figure 4:
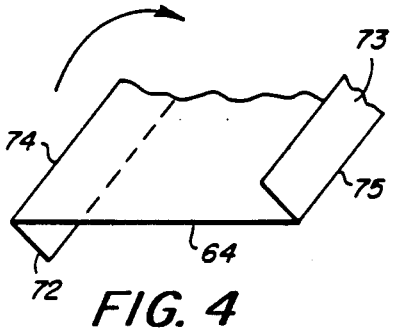
FIG. 4 illustrates the manner of forming the preferred embodiment wherein the two end portions of the flexible thin sheet-like member have end portion folded over so that when the sheet-like member is folded back on itself one end portion nests within the other.

In FIGS. 4, 5 and 6, a preferred embodiment of the sealing device according to the present invention is illustrated. FIG. 4 illustrates the manner of forming the tear drop seal wherein a deflexible thin sheet-like member 64 may be folded back on its self in the direction of the arrow after end portion 72 and 73 have been formed by creasing the sheet-like member 64 along fold line 74 and 75 such that to form "Z" shaped cross section. When the sheet-like member is folded back on its self, the end portion 72 and 73 are folded or creased in the same direction one nesting inside the other forming an acute angle $\theta$ with an adjacent portion of the deformed cylinder. A illustrated in FIG. 6, the width of the outermost folded end portion 73 is greater than the width of the innermost folded end portion 72 which permits the innermost folded end portion to move axially relative to the outermost folded end portion in response to misalignment in the mounting of the seal relative to the surface to be sealed. This enables the tear drop shape of the seal to maintain line contact sealing engagement with the surface to be sealed. By forming the end portions 72 and 73 of the sheet-like members 64 in the manner indicated with one nesting inside the other forming an acute angle with the adjacent portion of the deformed cylinder an anchoring the hook 77 is formed for supporting and anchoring the tear shaped seal in the seal holder housing 78 as illustrated in FIG. 5.

The seal holder housing 78 has a longitudinal seal anchoring hook supporting groove-like chamber 79 having a stop surface 80 at the top thereof for engagement with the edges 86 and 87 of the folded over end portions of 72 and 73, respectively. A narrow longitudinal seal insertion slot 82 is provided in the seal holding houser 78 for inserting the seal anchoring hook 77 into the groove-like chamber 79. This may be accomplished merely by manually crimping the folded over end portion 72 and 73 of the anchoring hook 77 by reducing the angle $\theta$ and snapping the anchoring hook into the seal insertion slot. On each side of the seal insertion slot 82 are retaining lips 83 and 84 extending longitudinally the length of the seal holder housing. By forming and mounting the tear drop seal in the manner illustrated, the inner end portion 72 being narrower than the width of the outer end portion 73, the short end portion 72 has the ability to move relative to the outer end portion 73 and in particular to slide back and forth axially relative to the outer end portion 73 in the groove-like chamber. The outer edge 87 of outer end portion 73 engages hard stop 80 provided at the top of the groove-like chamber 79 and while the edge 86 of the inner end portion 72 may engage the hard stop this is not necessary with the folded end portions of differing widths with the narrower one inside the wider one, the narrower one is permitted to "float" relative to the outer one which compensates for imperfections in or the mounting of the seal relative to that surface. This arrangement permits the innermost folded over end portion to move axially relative to the outermost folded over end portion so that the seal is straight and ripple free. As illustrated in FIG. 6, the inner end portion can move a distance "a" relative to the outer end portion thereby alternating slightly the configuration of the tear drop cross section. It is important that the narrower end portion be nested inside the wider end portion since otherwise the wider end portion would tend to pinch the short end portion so that it could not slide axially. By being able to slide axially, the seal is able to maintain the line contact sealing engagement.

The above-described tear drop seal may be used to provide a sealing engagement with an arcuate or flat surface so long as the sealing contact engagement with that surface can be straight. This is accomplished by locating holder housing such that the tear drop seal creates an angle of deflection from free style when in contact with the surface. This is illustrated in FIG. 5 wherein the dotted line represents the seal in its unrestrained or free state position and the solid line represents the deflected seal in sealing engagement with a surface. As a result of the tear drop configuration of the seal, it is difficult for the contact edge of the seal to be deflected. This is because the tear drop naturally forms a curve in the sheet-like member which naturally resists the formation of a second curve such as on a ripple in a direction which would be essentially perpendicular or transverse to the tear drop curve. As a result the tear drop keeps a straight edge sealing engagement across the surface which it is sealing.

The flexible sheet like member may be of any suitable material. Typical materials have a smooth surface and a low coefficient of friction with the surface with which they are in sealing contact and will not contribute to the buildup of static charge. Suitable materials may be selected from a variety of papers, films and commerically available plastics. Polyester films such as Mylar are particularly suitable. The sealing characteristics of the tear drop seal are a function of the properties and thickness of the sheet-like material, the width of the seal, and the amount of force urging the tear drop against the sealing surface. The more you deform the tear drop seal the more sealing force is generated. However, it should be noted that for many applications only a light or small sealing force may be appropriate. A typical thickness with such a sheet-like member is from about 0.03 to about 0.05 millimeters.

Figure 7:
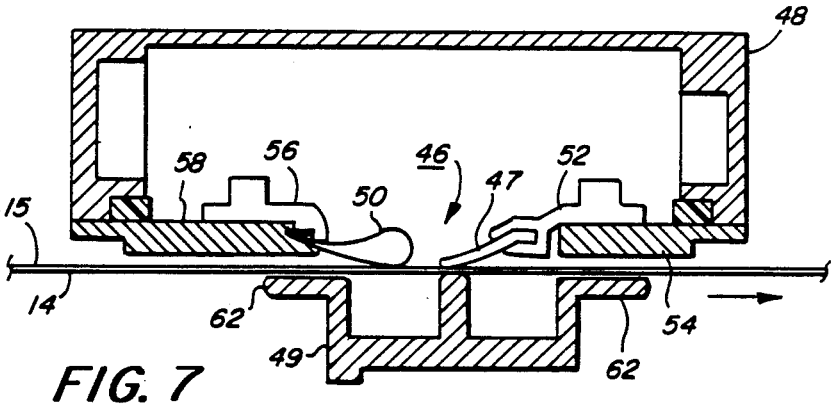
FIG. 7 is an enlarged view illustrating the use of the tear drop seal and a cleaner housing.

FIGS. 3 and 7 refer to specific applications of the tear drop seal according to the present invention. In FIG. 3, the developer station comprises a donor roll 28 which transports weakly charged insulating non-magnetic toner particles into contact with the electrostatic latent image recorded on the photoconductive surface of belt 14. Donor roll 28 rotates in the direction of the arrow. A toner particle supply reservoir 29 contained within developer housing 32 furnishes toner particles to the donor roll 28. A metering charging roller 31 contacts donor roll 28 to define a nip therebetween. Metering charging roller 31 rotates in the direction of the arrow as weakly charged toner particles on donor roll 28 pass through the nip between the metering charging roller 31 and the donor roll 28. As a result of the movement in opposite directions of metering charging roller and the donor roller, the toner particles in the nip acquire a charge thereon. These charged toner particles are then transported by the compliant donor roller 28 to the electrostatic latent image recorded on the photoconductive surface. The electrostatic latent image attracts the toner particles from the donor roller 28 to form a powder image on the photoconductive surface of belt 14. Doctor blade 35 has the free end thereof contacting metering charging roller 31 to act as a seal to prevent toner particles from advancing therebeyond. A tear drop seal such as the one described to FIG. 5 is mounted in a holder housing 79 and forms a line contact seal engagement with surface of the donor roll 28 along the axially length thereof. The sealing engagement provides two different functions in that it prevents toner in the toner sump 29 from leaking through the tear drop seal/donor roll engagement. In addition, it permits any residual toner on the donor roll 28 to be transported back into the toner sump 29 as the donor roll is rotated in the manner shown.

FIG. 7 illustrates the use of a tear drop seal in a cleaning station wherein a photoreceptor belt 14 having a photoconductive insulating surface 15 thereon is transported in the direction of the arrow from the cleaning station. The cleaning station 46 comprises a cleaning platen 49 positioned under the top horizontal of one of the imaging belt 14 with the cleaning housing 48 in opposed relationship on the top run of the photoconductive belt 14. Contained within the cleaner housing is a cleaning blade 47 rigidly held in blade holder 52 which is mounted to blade mount 54 which is mounted to the cleaner housing 48. The cleaning blade 47 by virtue of its position and beam deflection is in opposed interference relationship with the top surface of belt 14 supported by cleaning platen 49. Tear drop cleaning seal 50 with the configuration illustrated in FIG. 2 is held by seal holder 56 which is mounted to seal mount 58 upstream in the process direction of the cleaning blade. The tear drop seal is in contact with the photoreceptor 14 and insures that toner cleaned from the photoreceptor by the cleaning blade does not escape in the upstream direction from the cleaning housing 48. At the same time, the orientation of the tear drop seal permits residual toner tacked to the photoconductive belt 14 to be transported by the belt into the cleaner housing 48 to be cleaned or scrapped from the belt by the cleaning blade 47. It should be noted in the embodiments illustrated in FIGS. 3 and 7 that the ends of the developer housing and the cleaner housing are also provided with seals so that toner does not escape therefrom. This can be accomplished in any suitable manner such as with the use of a brush, more particularly, the brush end seals described in copending application Ser. No. 864,694 now U.S. Pat. No. 4,681,426 may be used for this purpose.

In the embodiments illustrated in FIGS. 3 and 7, the force of friction between the tear drop seal and any toner particles electrostatically adhered to the imaging member or doner roll is less than the electrostatic attractive force between the toner particles and the imaging member or donor roll. This permits the seal to allow toner passage in one direction.

Figure 8:
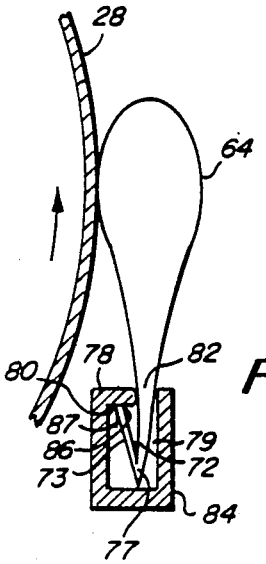
FIG. 8 illustrates an alternative embodiment of the preferred embodiment illustrated in FIGS. 5 and 6.

FIG. 8 is an alternative embodiment wherein the insertion slot 82 is at the top of the seal holder housing 78 rather than at one side as in FIGS. 5 and 6 and wherein the orientation of the anchoring hook 77 with respect to the surface to be sealed is reversed. In addition, retaining lip 83 may be omitted. The width of the outermost folded end portion remains greater than the width of the innermost folded end portion Thus, according to the present invention, a relatively inexpensive easy to assemble and replace sealing device has been provided. In particular, a satisfactory sealing arrangement has been provided for developer housings and cleaner housings in electrostatographic printing apparatus. The tear drop seal avoids the effects of misalignment between the seal holder and the surface to be sealed while at the same time maintaining line contact sealing engagement with the surface. It will of course be understood that the figures generally illustrate the seal in cross section and that the sealing engagement is continuous along the longitudinal interface between the seal and the surface to be sealed. It will also be understood that the sealing engagement may comprise an area contact along the longitudinal interface between the seal and the surface to be sealed.

The disclosures of the patents and applications referred to herein are specifically and totally incorporated herein by reference.

While the invention has been described with reference to specific embodiments, it will be apparent to those skilled in the art that many alternatives, modifications and variations may be made. For example, while the invention has been illustrated with an electrostatic latent image formed by the exposure of an electrostatically charged photoconductive member to a light image of an original document, the electrostatic latent image may be alternatively generated from information electronically stored or generated in digital form and a laser beam modulated to selectively discharge portions of the photoconductive surface as in a printer application. Furthermore, while the invention has been described as being useful as a seal for particulate material it has application also as a fluid seal. Accordingly, it is intended to embrace all such alternatives and modifications that may fall within the spirit and scope of the appended claims.

I claim:

1. A device for sealing a space adjacent a linear portion of a surface comprising a seal holding means, a flexible thin sheet-like member folded over on itself forming a deformed cylinder having a generally tear drop shaped cross section two ends of said folded back sheet-like member being held and retained in close proximity by said seal holding means to maintain said tear drop shaped cross section of said folded back sheet-like member, said seal holding means being mountable relative to said surface such that a portion of the deformed cylinder forms at least a line contact seal engagement with said surface.

2. The sealing device of claim 1 wherein the two ends of said sheet-like member are fastened together in said seal holding means.

3. The sealing device of claim 2 wherein said two fastened ends of said sheet-like member are fastened to said seal holding means.

4. The sealing device of claim 1 including two surfaces arranged in a generally parallel relationship to each other to form a space therebetween and wherein said seal holding means is mounted to one of said surfaces such that a portion of the deformed cylinder forms at least a line contact seal engagement with the other of said surfaces.

5. The sealing arrangement of claim 4 wherein one surface moves relative to the other surface.

6. The sealing arrangement of claim 5 wherein the moving surface is the surface of a rotatable cylindrical member.

7. The sealing arrangement of claim 5 wherein the moving surface is a flat run of an endless belt.

8. The sealing device of claim 1 wherein said two ends of said folded back sheet-like member have end portions folded over in the same direction one nesting inside the other forming an acute angle with an adjacent portion of the deformed cylinder, the width of the outermost folded end portion being greater than the width of the innermost folded end portion, said nested folded end portions providing an anchoring hook for supporting engagement with said seal holding means, said seal holding means permitting said innermost folded end portion to move axially relative to such outermost folded end portion to maintain line contact seal engagement with said surface.

9. The sealing device of claim 8 wherein said seal holding means comprises a housing with a longitudinal seal anchoring hook supporting groove-like chamber having a stop surface for engagement with the edges of said folded over end portions, a narrow longitudinal seal insertion slot for inserting said seal anchoring hook into said groove-like chamber and at least one anchoring hook retaining lips on a side of said insertion slot for retaining said anchoring hook in said groove-like chamber, said engagement of said stop surface with the edges of said folded over end portions permitting said innermost folded over end portion to move axially relative to said outermost folded over end portion.

10. The sealing device of claim 1 wherein said flexible thin sheet-like member is a polyester film about 0.030 to about 0.050 mm in thickness.

11. In an electrostatographic reproducing apparatus comprising a charge retentive surface movable through an endless path past a series of processing stations to provide a developed image on an image receiving substrate including a developer housing for containing developer material, a rotatable cylindrical donor roll for delivering developer material from said developer housing to said charge retentive surface, said housing and donor roll forming a space therebetween extending in the axial direction of the donor roll and defined by the donor roll surface and a portion of the developer housing in substantially parallel relationship to said donor roll surface means to seal said space to prevent developer material contained within the housing from escaping therefrom, said sealing means comprising a seal holding means, a flexible thin sheet-like member folded back on itself forming a deformed cylinder having a generally tear drop shape cross section, two ends of said folded back sheet-like member being held and retained in close proximity by said seal holding means to maintain said tear drop shape cross section of said folded back sheet-like member, said seal holding means being mounted to said portion of the developer housing such that a portion of the deformed cylinder is urged against and forms at least a line contact seal engagement with the surface of said donor roll.

12. The apparatus of claim 11 wherein said two ends of said folded back sheet-like member have end portions folded over in the same direction one nesting inside the other forming an acute angle with an adjacent portion of the deformed cylinder, the width of the outermost folded end portion being greater than the width of the innermost folded end portion, said nested folded end portions providing an anchoring hook for supporting engagement with said seal holding means, said seal holding means permitting said innermost folded end portion to move axially relative to aid outermost folded end portion to maintain line contact seal engagement with said surface.

13. The apparatus of claim 12 wherein said seal holding means comprises a housing with a longitudinal seal anchoring hook supporting groove-like chamber having a stop surface for engagement with the edges of said folded over end portions, a narrow longitudinal seal insertion slot for inserting said seal anchoring hook into said groove-like chamber and at least one anchoring hook retaining lips on a side of said insertion slot for retaining said anchoring hook in said groove-like chamber, said engagement of said stop surface with the edges of said folded over end portions permitting said innermost folded over end portion to move axially relative to said outermost folded over end portion.

14. The apparatus of claim 11 wherein said flexible thin sheet-like member is a polyester film from about 0.03 to about 0.05 mm in thickness.

15. The apparatus of claim 11 further including a charging roller positioned in contact with said donor roller to define a nip therebetween to charge developer material.

16. The apparatus of claim 11 wherein said sealing means permits any residual developer material remaining on said developer roll after development to remain tacked to said donor roll and re-enter said developer housing.

17. In an electrostatographic reproducing apparatus comprising a charge retentive surface movable through an endless path past a series of processing stations to provide a developed image on an image receiving substrate, including a cleaner apparatus for removing and collecting residual developer from said charge retentive surface comprising an enclosed cleaner housing including a residual developer sump, cleaning means for cleaning residual developer from said surface said housing and said surface forming a space therebetween and sealing means to prevent residual developer material contained within the housing from escaping therefrom, said sealing means comprising a seal holding means, a flexible thin sheet-like member folded back on itself forming a deformed cylinder having a generally tear drop shape cross section, two ends of said folded back sheet-like member being held and retained in close proximity by said seal holding means to maintain said tear drop shape cross section of said folded back sheet-like member, said seal holding means being mounted to said cleaner housing such that a portion of the deformed cylinder is urged against and forms at least a line contact seal engagement with the surface of said charge retentive surface.

18. The apparatus of claim 17 wherein the two ends of said sheet-like member are fastened together in said seal holding means.

19. The apparatus of claim 18 wherein said two fastened ends of said sheet-like member are fastened to said seal holding means.

20. The apparatus of claim 17 wherein said two ends of said folded back sheet-like member have end portions folded over in the same direction one nesting inside the other forming an acute angle with an adjacent portion of the deformed cylinder, the width of the outermost folded end portion being greater than the width of the innermost folded end portion, said nested folded end portions providing an anchoring hook for supporting engagement with said seal holding means, said seal holding means permitting said innermost folded end portion to move axially relative to such outermost folded end portion to maintain line contact seal engagement with said surface.

21. The apparatus of claim 20 wherein said seal holding means comprises a housing with a longitudinal seal anchoring hook supporting groove-like chamber having a stop surface for engagement with the edges of said folded over end portions, a narrow longitudinal seal insertion slot for inserting said seal anchoring hook into said groove-like chamber and at least one anchoring hook retaining lip on a side of said insertion slot for retaining said anchoring hook in said groove-like chamber, said engagement of said stop surface with the edges of said folded over end portions permitting said innermost folded over end portion to move axially relative to said outermost folded over end portion.

22. The apparatus of claim 17 wherein said flexible thin sheet-like member is a polyester film from about 0.03 to about 0.05 mm in thickness.

* * * * *